United States Patent [19]

Ueno et al.

[11] Patent Number: 4,668,154

[45] Date of Patent: May 26, 1987

[54] ATTACHMENT APPARATUS FOR CRANE OR THE LIKE

[75] Inventors: Yutaka Ueno; Toyohiko Tsuchida; Akira Matsuoka, all of Kumamoto, Japan

[73] Assignee: Kongo Co., Ltd., Kumamoto, Japan

[21] Appl. No.: 751,971

[22] Filed: Jul. 5, 1985

[30] Foreign Application Priority Data

| | | | |
|---|---|---|---|
| Dec. 25, 1984 | [JP] | Japan | 59-272100 |
| Jan. 31, 1985 | [JP] | Japan | 60-16958 |
| Feb. 8, 1985 | [JP] | Japan | 60-23193 |
| May 10, 1985 | [JP] | Japan | 60-99053 |

[51] Int. Cl.[4] ..... B66C 19/00

[52] U.S. Cl. ..... 414/607; 212/154; 212/156; 414/630; 414/667; 414/671

[58] Field of Search ..... 212/149, 150, 154, 128, 212/220, 221; 414/607, 662, 274, 630, 275, 671, 282, 451; 294/67.21, 67.5; 33/366, 395, 333

[56] References Cited

U.S. PATENT DOCUMENTS

| | | | |
|---|---|---|---|
| 2,644,593 | 7/1953 | Miller | 212/128 |
| 2,772,794 | 12/1956 | Cromer et al. | 294/67.21 |
| 2,822,101 | 2/1958 | Schenbelberger | 414/667 |
| 2,998,278 | 8/1961 | Daiuta | 294/67.21 |
| 3,174,634 | 3/1965 | Peck | 414/541 |
| 3,232,455 | 2/1966 | Fountain et al. | 414/282 |
| 3,341,243 | 9/1967 | Ancher | 294/67.21 |
| 3,389,814 | 6/1968 | Lemelson | 414/274 |
| 3,516,559 | 6/1970 | Walter | 414/541 |
| 3,606,955 | 9/1971 | Saul | 414/275 |
| 3,762,755 | 10/1973 | Saether | 294/67.21 |
| 3,810,551 | 5/1974 | Bust et al. | 212/128 |
| 3,865,265 | 2/1975 | Brudi et al. | 33/366 |
| 3,974,927 | 8/1976 | Schuster | 414/667 |
| 3,998,488 | 12/1976 | Durgan | 294/67.21 |
| 4,138,824 | 2/1979 | Ponce de Leon | 33/366 |
| 4,251,098 | 2/1981 | Belinsky | 294/67.21 |
| 4,256,337 | 3/1981 | Wappler | 294/67.21 |

*Primary Examiner*—Lawrence J. Oresky
*Attorney, Agent, or Firm*—Parkhurst & Oliff

[57] ABSTRACT

An attachment apparatus is arranged to be suspended from an overhead travelling crane or other similar means and is employed for a cargo handling operation, for example, unloading an article placed on a shelf or rack. The attachment apparatus includes a frame section adapted to be suspended from a hook attached to a crane, a fork section movably mounted on the frame section and adapted to scoope up an article, and a driving section for driving the fork section. The frame section has a ceiling member equipped with a suspension member, the mounting position of the suspension member being adjustable. The fork section has a pair of fork members, the distance therebetween being adjustable.

9 Claims, 37 Drawing Figures

ATTACHMENT APPARATUS FOR CRANE OR THE LIKE

BACKGROUND OF THE INVENTION

1. Field of the Invention

The present invention relates to an attachment apparatus for use in a crane or other cargo handling equipment.

2. Description of the Prior Art

In a cargo handling operation, a crane or a fork lift truck is generally employed in accordance with a particular situation. To unload articles placed on a rack or a similar structure, a crane is not generally used alone, and it is common to equip a crane with a fork-type attachment. In this case, however, it is necessary to align the center of gravity of an article with the center of suspension and to employ a special arrangement for the rack or shelf, which fact involves an extremely low operating efficiency. A conventional attachment apparatus is, as shown is FIGS. 36A and 36B, arranged such that the position of suspension is changed in accordance with the weight of each of the articles A. With such an attachment apparatus, although it is convenient to lift up the article A when it is placed on the floor, it is impossible to unload the article A when it is placed on a shelf. In the latter case, it is accordingly necessary to design a slide-type shelf on which it is possible for the article A to be easily pulled out to the front side of the shelf where the article A can be lifted up by the attachment apparatus.

In the case where certain articles are handled, for example, when an article of continuous length is to be unloaded from a shelf, it is inconveniently necessary to employ two or more attachment apparatuses in order to handle the article in a well-balanced state. Moreover, when an article to be handled has an excessively large size or weight, it is not possible for the conventional attachment apparatus to align the center of gravity of an article with the center of suspension in order to obtain a well-balanced condition of the article.

Further, employment of an overhead travelling crane involves an unfavorably low operating efficiency and certain risks in a goods handling operation, since the crane is incomplete in terms of the control of its brake system, that is, it is not possible for the crane to stop immediately in response to a power supply cut-off of the driving means, and the crane undesirably moves a certain distance before coming to a stop.

On the other hand, when a fork lift truck is employed, a space is needed to allow the fork lift truck to move freely. An article of continuous length requires a particularly large space. Thus, cargo handling operations involve various kinds of restrictions.

SUMMARY OF THE INVENTION

It is an object of the present invention to provide an attachment apparatus which includes a frame section adapted to be suspended from a hook attached to a crane, a fork section mounted on the frame section to be movable longitudinally with respect to an upright member of the frame section and adapted to scoop up an article, and a driving section installed on the frame section and adapted to drive the fork section.

It is another object of the present invention to provide an attachment apparatus of the above-described type which further includes a position control mechanism adapted to control the position of the attachment apparatus.

It is still another object of the present invention to provide an attachment apparatus of the above-described type for an overhead travelling crane which further includes a control circuit for effecting control such that, when the attachment apparatus abuts against a structure for storing an article, the movement of the crane toward the storing structure is suspended and the operation of reversing the moving direction of the crane alone is permitted. This attachment apparatus incorporates a control circuit adapted to decrease the moving speed of the overhead travelling crane when it is travelling and traversing for scanning.

It is a further object of the present invention to provide a control circuit for controlling an attachment apparatus for a crane, the attachment apparatus including a frame section adapted to be suspended from a hook attached to the crane, a fork section movably mounted on the frame section and adapted to scoop up an article, a driving section mounted on the frame section and adapted to drive the fork section, and a position control mechanism adapted for controlling the position of the attachment apparatus, whereby any tilting condition of the attachment apparatus in any of the forward, backward and sideward directions is automatically sensed so as to allow for manual correction. Further, the position control mechanism includes a tilting sensor which is arranged such that a switch in the sensor is closed in accordance with the tilting direction of the attachment apparatus, thereby automatically sensing the tilting direction of the attachment apparatus at any given time.

These and other objects, features and advantages of the present invention will become clear from the following description of the preferred embodiments thereof, taken in conjunction with the accompanying drawings.

DESCRIPTION OF THE PREFERRED EMBODIMENTS

Figure 1:
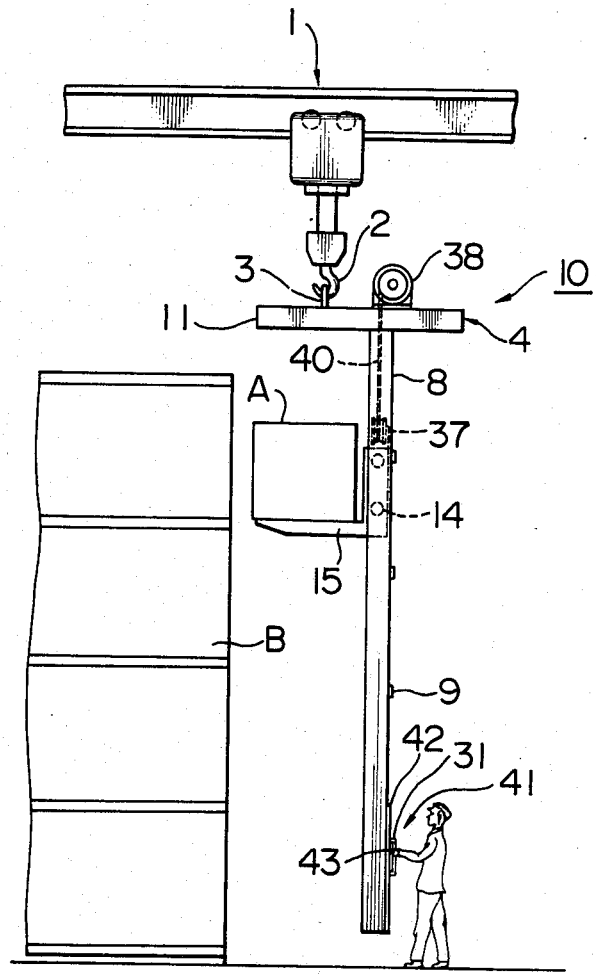
FIG. 1 is a side elevational view of an attachment apparatus in accordance with a first embodiment of the present invention, the attachment apparatus being suspended from an overhead travelling crane.
Figure 2:
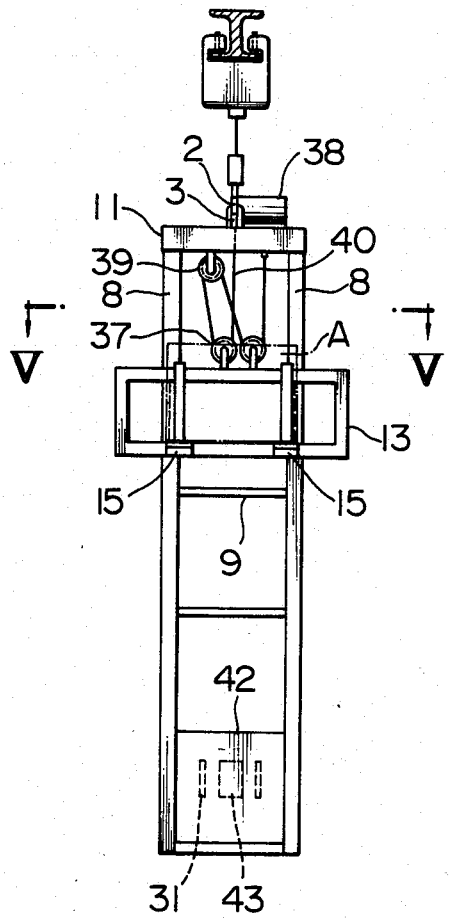
FIG. 2 is a front elevational view of the attachment apparatus shown in FIG. 1.
Figure 3:
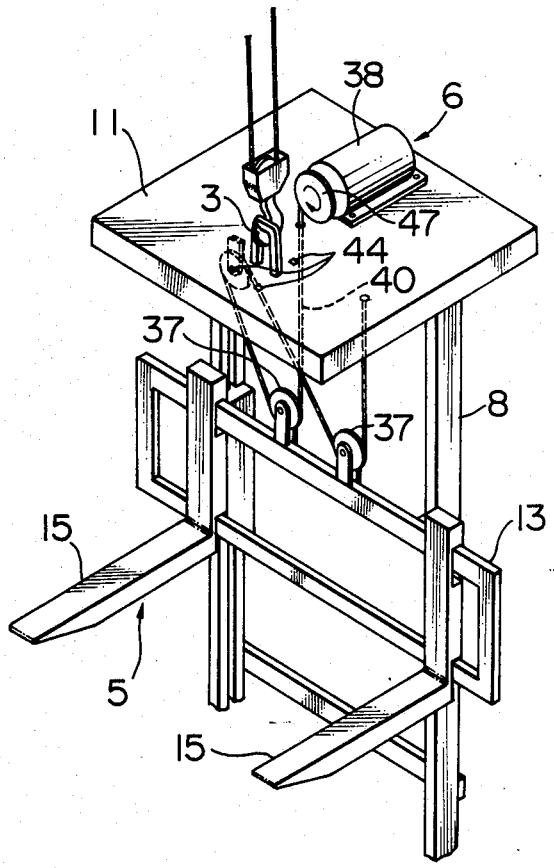
FIG. 3 is a perspective view of the upper part of the attachment apparatus shown in FIG. 1.

Referring first to FIGS. 1 to 3, there is shown an attachment apparatus 10 in accordance with a first embodiment of the invention, the apparatus 10 being suspended from a hook 2 attached to an overhead travelling crane 1. The apparatus 10 includes a frame section 4, a fork section 5 movably mounted on the frame section 4 and adapted to scoop up an article A, a driving section 6 mounted on the frame section 4 and adapted to drive the fork section 5, and a control section 41 adapted to actuate the driving section 6 and thereby to operate the fork section 5.

The frame section 4 includes a ceiling member 11, a pair of guide rails 8 secured to the ceiling member 11, and cross members 9 secured to the guide rails 8 at proper distances in the longitudinal direction thereof. As shown in FIG. 3, the ceiling member 11 is formed with a plurality of bores 44, and a suspension member 3 is mounted through a pair of bores 44 selected in the following manner. Each of the guide rails 8 is, as shown in FIGS. 5 and 6, composed of a rod like member 45 with a rectangular cross-section and a channel member 46 which is secured to the rod-like member 45.

Figure 5:
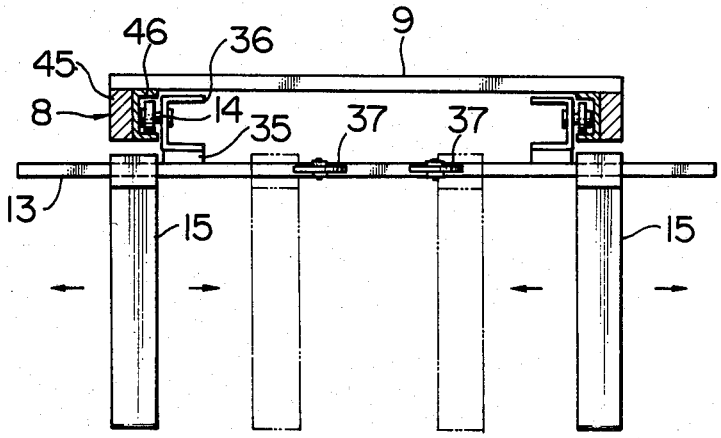
FIG. 5 is a sectional view taken along the line V—V of FIG. 2.
Figure 6:
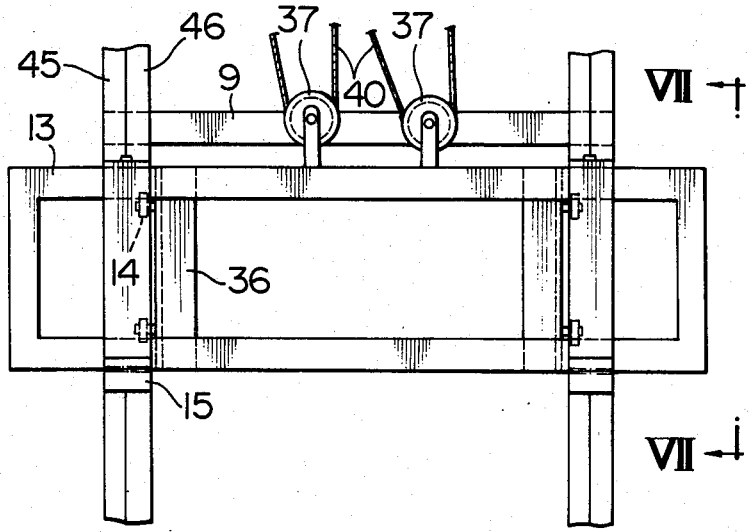
FIG. 6 is a fragmentary front elevational view of a part of both the fork and frame sections of the attachment apparatus.
Figure 7:
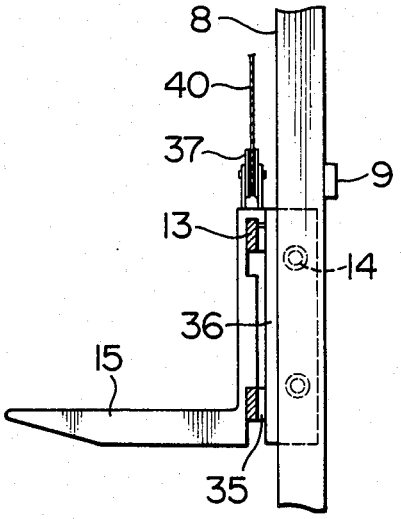
FIG. 7 is a fragmentary side elevation as viewed in the direction of the arrows VII—VII of FIG. 6.

Referring next to FIGS. 5 to 7, the fork section 5 includes a pair of fork members 15, a fork supporting frame 13 which supports these fork members 15, guide roller supporting members 36 secured to the fork supporting frame 13 through respective spacers 35, and guide rollers 14 rotatably mounted on these guide roller supporting members 36. The fork supporting frame 13 has two pulleys 37 rotatably mounted on its upper end. The pair of fork members 15 are slidably supported on the fork supporting frame 13 so that it is possible to adjust the position of the fork members 15 in the lateral direction of the fork supporting frame 13.

The driving section 6, as shown in FIGS. 1 to 3, includes a motor 38 mounted on the ceiling member 11, a pulley 39 rotatably mounted on the lower side of the ceiling member 11, the above-described pulleys 37 mounted on the fork supporting frame 13, and a wire 40. The wire 40 has one end thereof secured to an appropriate position on the ceiling member 11 and the other end secured to a pulley 47 which is mounted on the output shaft of the motor 38, the wire 40 thus being passed over the pulleys 37, 39 and 47.

Figure 4:
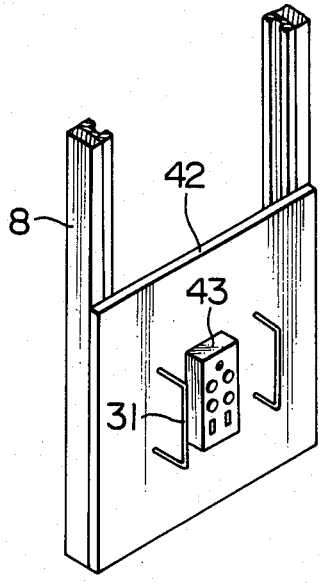
FIG. 4 is a perspective view of a control section of the attachment apparatus shown in FIG. 1.

The control section 41, as shown in FIG. 4, includes a control panel 42 secured to the guide rails 8, a pair of handles 42 mounted on the panel 42, and a switch box 43 mounted on the panel 42 between the handles 31.

In operation, when the article A placed on a rack (not shown) is to be transferred to a shelf B, or when the article A placed on the shelf B is to be unloaded therefrom, the suspension member 3 is previously mounted through the bores 44 in the ceiling member 11 which are properly selected depending upon the weight of the article A, and the attachment apparatus 10 is suspended from the hook 2 of the overhead travelling crane 1 through the suspension member 11. The crane 1 is then actuated to move the attachment apparatus 10 to a position where it faces the shelf B. The operator actuates the switch box 43 while gripping one of the handles 31 as shown in FIG. 1, thereby properly moving the fork section 5 up and down until the position of the fork members 15 corresponds to that position of a desired shelf. Then, the overhead travelling crane 1 is actuated to transfer the article A from the fork members 15 to the shelf B, or vice versa. Thereafter, the crane 1 is actuated to move the attachment apparatus 10 to a desired position. The distance between the pair of fork members 15 has previously been adjusted depending upon the width of the article A which is to be handled.

Although the operation of the overhead travelling crane 1 is controlled through the switch box 43 in this embodiment, it is possible to control the crane 1 from a control section separately provided. In such a case, the arrangement may be such that it is not possible for the latter control section to actuate the overhead travelling crane 1 when the crane 1 is used with the attachment apparatus 10 suspended therefrom.

Figure 8:
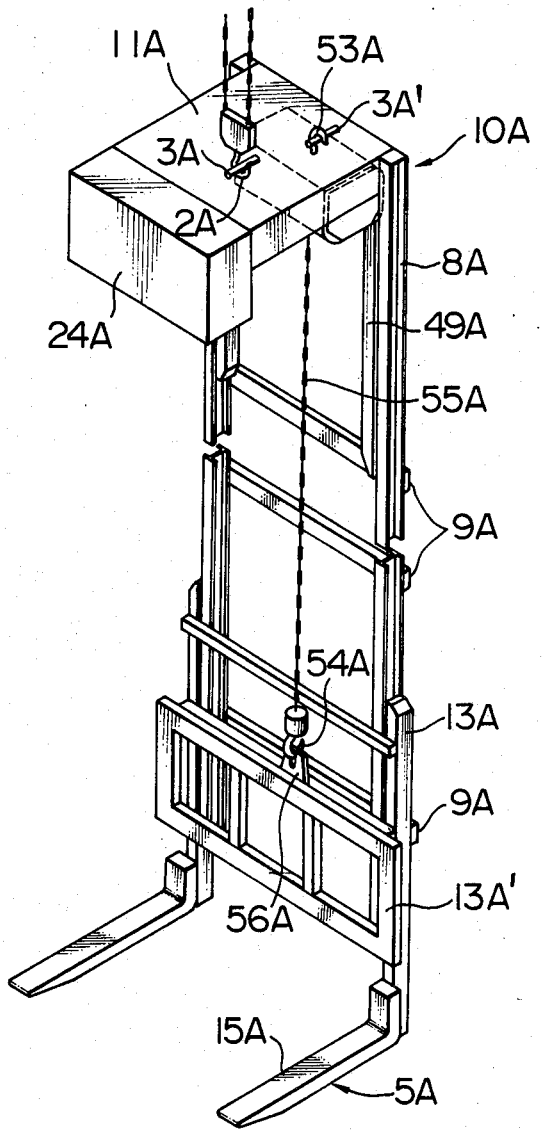
FIGS. 8 to 10 show in combination an attachment apparatus in accordance with a second embodiment of the invention, FIG. 8 being a perspective view, FIG. 9 being a side elevational view, and FIG. 10 being a front elevational view.
Figure 9:
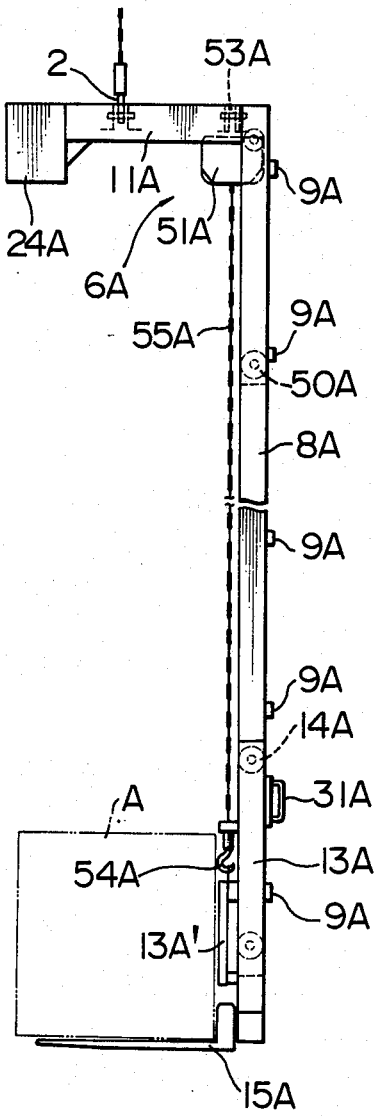
Figure 10:
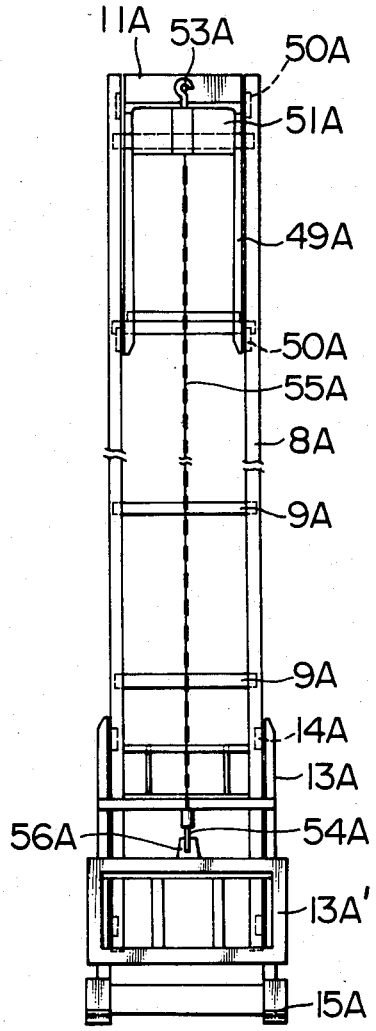

Referring now to FIGS. 8 to 10, there is shown an attachment apparatus 10A in accordance with a second embodiment of the invention. The second embodiment differs from the first embodiment in that a suspension member 3A adapted to be suspended from the hook 2 of the overhead travelling crane 1 is fixed to a ceiling member 11A so that it is not possible to adjust the position of the suspension member 3A, in that it is possible to change the position of a driving section 6A for driving a fork section 5A along upright members, that is, guide rails 8A, and in that a counterweight 24A is mounted on the ceiling member 11A at a position where the weight 24A faces the guide rails 8A. As illustrated, the driving section 6A includes a driving section supporting frame 49A, two pairs of rollers 50A mounted on the frame 49A, and a hoist 51A secured to the frame 49A. As shown in FIG. 8, each of the guide rails 8A is formed from a rolled steel of H-section. The arrangement is such that the rollers 50A on the frame 49A roll within the respective inner grooves of the guide rails 8A. The hoist 51A is suspended through a hook 53A from a rod 3A' which is secured to the ceiling member 11A, the hook 53A being connected to the hoist 51A through a chain or wire (not shown) whose length is adjustable.

The fork section 5A has a fork frame 13A to which are secured both a pair of fork members 15A and a cross frame 13A'. Two pairs of rollers 14A are rotatably mounted on the fork frame 13A. The cross frame 13A' has a suspension member 56A secured to the center of its upper end. Thus, the cross frame 13A' is suspended through the suspension member 56A from a hook 54A which is secured to one end of a chain or wire 55A paid out from the hoist 51A.

The pair of guide rails 8A are fixedly supported by a plurality of cross members 9A in such a manner as to be parallel to each other. The length of the guide rails 8A is determined such that, when the fork members 15A move for the purpose of loading or unloading the article A onto or from the shelf B or the rack, neither the counter weight 24A nor the ceiling member 11A interferes with any other article on the upper-most shelf or on the rack. When the length of the guide rails 8A is not large enough to cover the overall height of the shelf or the rack, it is possible to cope with such a situation by adding a required length of rolled steel to each of the guide rails 8A by the use of bolts or other proper means. In this case, the chain or wire which connects the hook 53A and the hoist 51A is wound off by an amount corresponding to the length of the extended portions of the guide rails 8A, whereby it is possible to maintain the movement of the fork section 5A within given limits.

Figure 11:
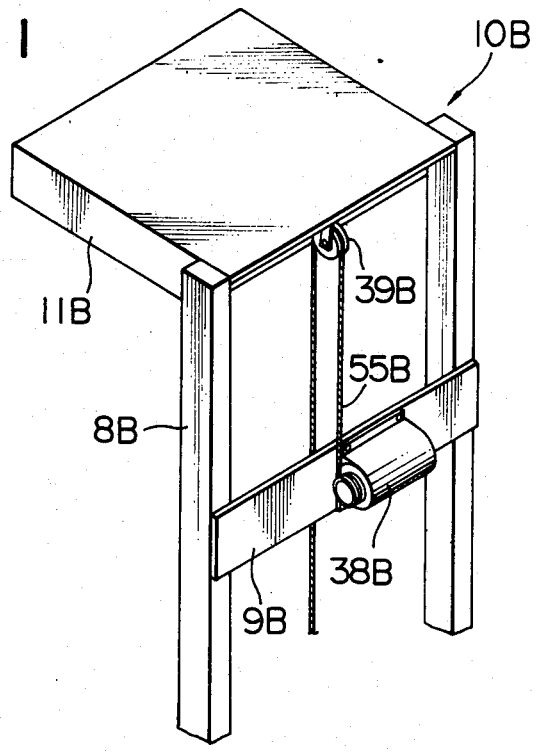
FIGS. 11 and 12 respectively show third and fourth embodiments of the invention.

Referring next to FIG. 11, there is shown an attachment apparatus 10B in accordance with a third embodiment of the invention. This attachment apparatus 10B is arranged in a manner similar to that of the attachment apparatus 10A in accordance with the second embodiment which is shown in FIGS. 8 to 10, except that a motor 38B having a pulley secured to its output shaft and adapted to drive the fork section is mounted on a cross member 9B of the frame section, and that a idle pulley 39B is mounted on a ceiling member 11B and has a wire 55B passed thereover.

Figure 12:
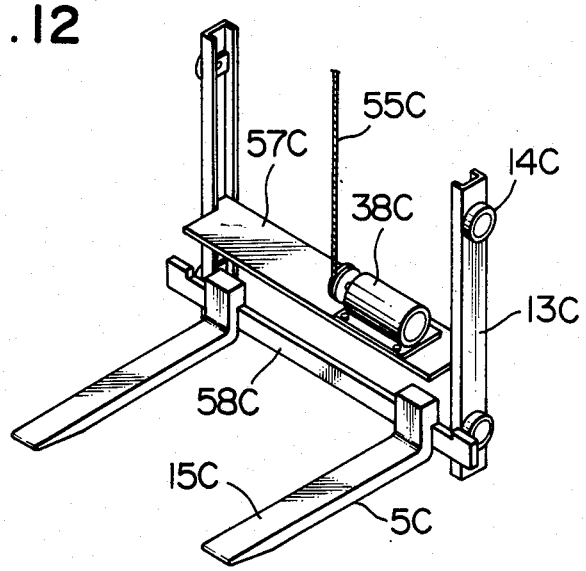
Figure 13:
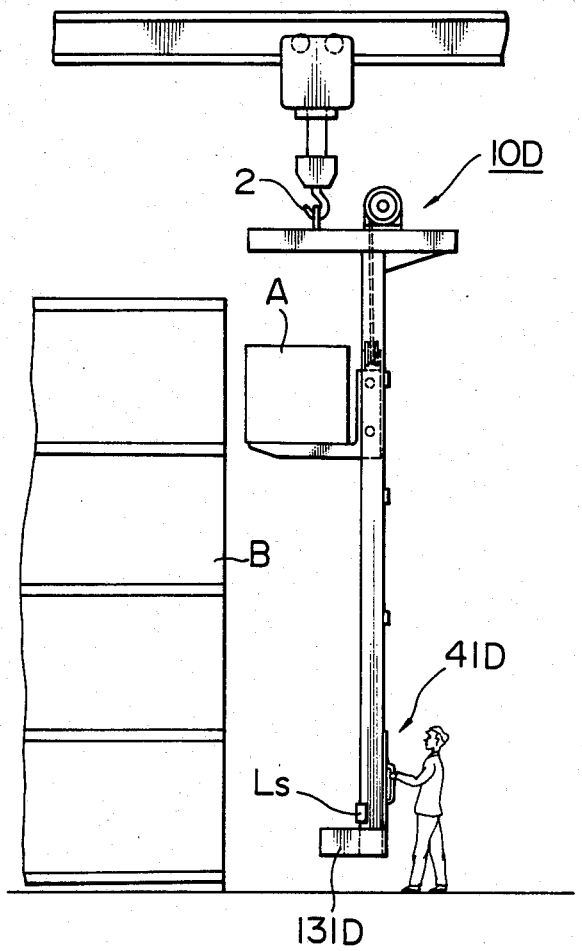
FIG. 13 is a side elevational view of an attachment apparatus in accordance with a fifth embodiment of the invention, the attachment apparatus being suspended from an overhead travelling crane.
Figure 14:
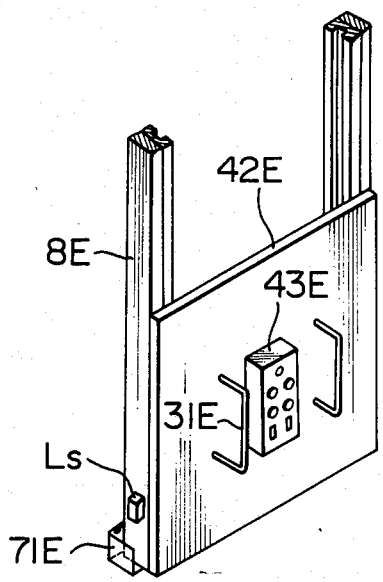
FIG. 14 is a perspective view of a control section of the attachment apparatus shown in FIG. 13.

FIG. 12 shows a fourth embodiment of the invention which differs from the second embodiment shown in FIGS. 8 to 10 in that a motor 38C for driving a fork section 5C is installed on the fork section 5C itself. More specifically, a fork frame 13C of the fork section 5C has two pairs of rollers 14C mounted on its outer side portions in such a manner that the fork frame 13C is movable vertically along the opposing inner sides of the upright members of the frame section. Further, a joint plate 57C and a slide member 58C are secured to the fork frame 13C. The motor 38C having a pulley secured to its output shaft is mounted on the joint plate 57C. The end of a length of wire 55C on the side thereof remote from the motor 38C is engaged with an appropriate portion of the ceiling member through a hook. Alternatively, that end of the wire 55C may be passed over a pulley mounted on the ceiling member and secured to the joint plate 57C. A pair of fork members 15C are slidable on the slide member 58C secured to the fork frame 13C, whereby it is possible for the distance between the fork members 15C to be properly adjusted.

Referring next to FIGS. 13 to 17, there is shown an attachment apparatus 10D in accordance with a fifth embodiment of the invention. The description which follows refers only to those points in which the fifth embodiment differs from the first embodiment shown in FIGS. 1 to 3.

In this attachment apparatus 10D, a control section 41D further includes a control circuit which is adapted to control the travelling and traversing of the overhead travelling crane. The reference numeral 131D denotes a safety bar which is adapted to detect engagement of the attachment apparatus 10D with the shelf B or the rack by means of a safety bar switch $L_S$.

Figure 15:
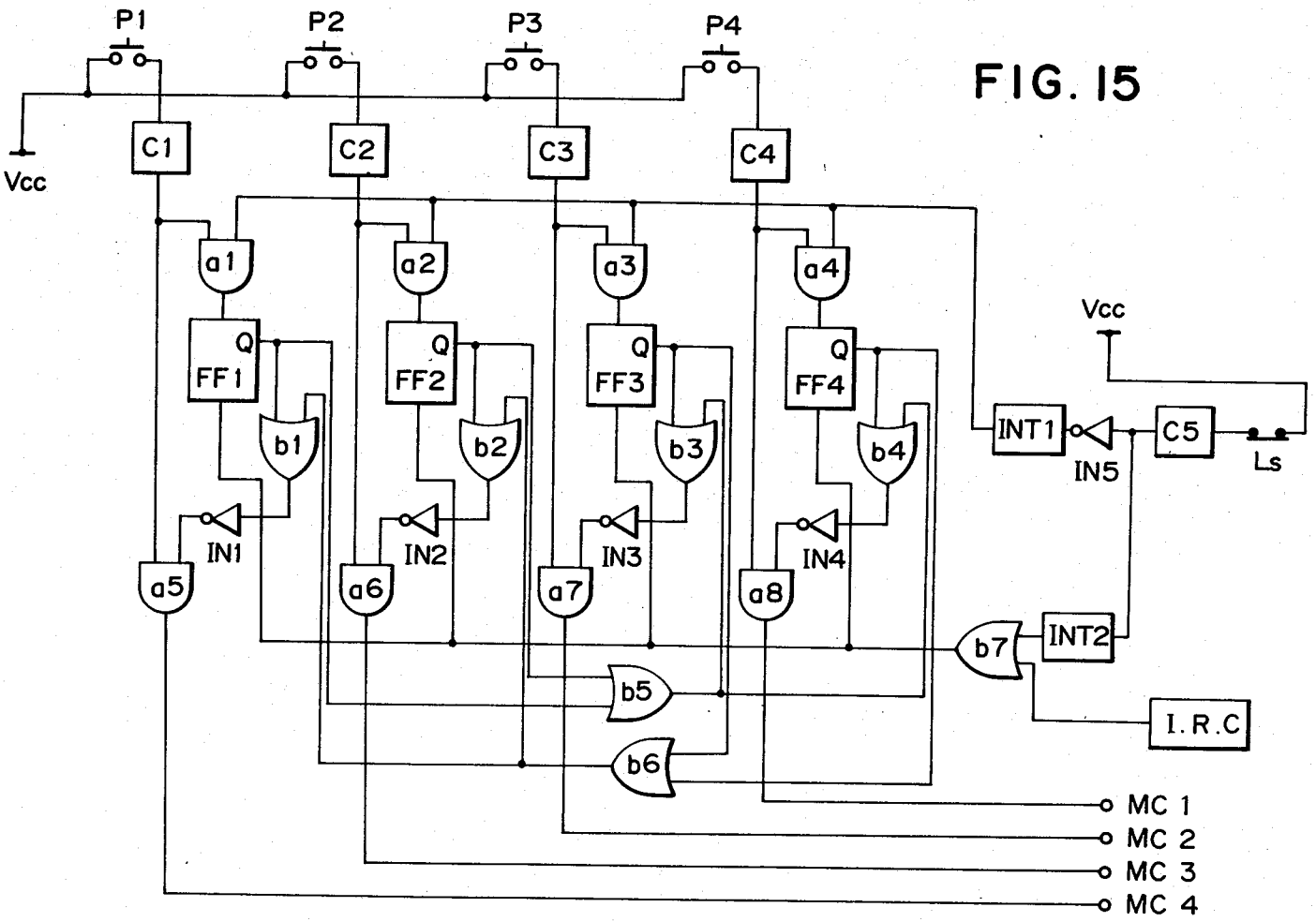
FIG. 15 is a circuit diagram of a controller employed to control the attachment apparatus shown in FIG. 13.

The arrangement of the control circuit employed in the attachment apparatus 10D in accordance with the fifth embodiment will now be described while explaining the operation thereof with reference to FIG. 15.

The reference symbols $P_1$ to $P_4$ denote control switches which are actuated when operating the overhead travelling crane, the switches $P_1$ and $P_2$ for controlling the travelling of the crane, and the switches $P_3$ and $P_4$ for controlling the traversing thereof. By selectively pressing the control switches $P_1$ to $P_4$, the overhead travelling crane is caused to travel or traverse. More specifically, when the control switches $P_1$ to $P_4$ are pressed, "H" (high) signals are respectively input to AND circuits $a_1$ to $a_4$ from switch output circuits $C_1$ to $C_4$, which are adapted to output "H" signals when the respective control switches $P_1$ to $P_4$ are ON. The "H" signals respectively output from the switch output circuits $C_1$ to $C_4$ are also respectively input to AND circuits $a_5$ to $a_8$. However, since the safety bar switch $L_S$ is in an inoperative state at this time, an "L" (low) signal is supplied to the other input of each of the AND circuits $a_1$ to $a_4$. In consequence, the AND circuits $a_1$ to $a_4$ respectively output "L" signals, which are respectively input to flip-flops $FF_1$ to $FF_4$. Since the flip-flops $FF_1$ to $FF_4$ are supplied with an "H" signal as an initial reset signal from an initial reset circuit IRC, the respective Q-terminal outputs of the flip-flops $FF_1$ to $FF_4$ are at the low level. Hence, "H" signals are respectively input to the AND circuits $a_5$ to $a_8$ via OR circuits $b_1$ to $b_4$ and inverter circuits $I_{N1}$ to $I_{N4}$, whereby a travelling/traversing command signal is output from any of the AND circuits $a_5$ to $a_8$.

When the safety bar 131D abuts against the shelf B or the rack in a state wherein any one of the control switches $P_1$ to $P_4$, for example, the control switch $P_1$, is being actuated, the AND circuit $a_1$ is supplied with an "H" signal via the safety bar switch $L_S$, a switch output circuit $C_5$, an inverter circuit $I_{N5}$ and an integrating circuit $INT_1$, and an "H" signal is input to the flip flop $FF_1$, an "H" signal thus being output from the Q-terminal thereof. This "H" signal is changed to an "L" signal through the OR circuit $b_1$ and the inverter circuit $I_{N1}$ and is then input to the AND circuit $a_5$. In consequence, the output of the AND circuit $a_5$ becomes low in level, whereby the travelling command signal is cancelled.

Since, at this time, the "H" signal output from the Q-terminal of the flip-flop $FF_1$ is also input to the OR circuits $b_3$ and $b_4$ through an OR circuit $b_5$, the respective inputs of the AND circuit $a_7$ and $a_8$ become low in level. Accordingly, even if the control switches $P_3$ and $P_4$ are actuated, the respective outputs of the AND circuits $a_7$ and $a_8$ are not raised and, therefore, no traversing command signal is output. Thus, the "H" signal from the Q-terminal of the flip-flop $FF_1$ is input to the OR circuit $b_2$ alone, so that it is possible for the control switch $P_2$ alone to be actuated.

In other words, it is possible to actuate only the control switch $P_2$, this switch being capable of moving the attachment apparatus 10D in the opposite direction relative to the direction in which the apparatus 10D is moved by the operation of the control switch $P_1$ which was first actuated.

When the safety bar 131D is separated from the shelf B or the rack by the operation of the control switch $P_2$ and the safety switch $L_S$ is thereby returned to its previous state, an "H" signal is input to the reset (CL) terminal of the flip-flop $FF_1$ via the switch output circuit $C_5$, an integrating circuit $INT_2$ and an OR circuit $b_7$. In consequence, an "L" signal is output from the Q-terminal of the flip-flop $FF_1$, and the output of the OR circuit $b_1$ becomes low in level. Accordingly, the crane stop signals are cancelled, and it becomes possible to effect a normal operation of the attachment apparatus 10D.

More specifically, the attachment apparatus 10D is suspended from the overhead travelling crane 1 through the hook 2 alone, which arrangement involves a risk of the apparatus 10D turning when it abuts against the shelf B or the rack. However, employment of the above-described control circuit makes it possible to effect control in such a manner that the crane 1 is moved only in such a direction that the attachment apparatus 10D does not abut against the shelf B or the rack by judging the particular travelling or traversing direction of the crane 1 in which the attachment apparatus 10D may abut against the shelf B or the rack.

Figure 16:
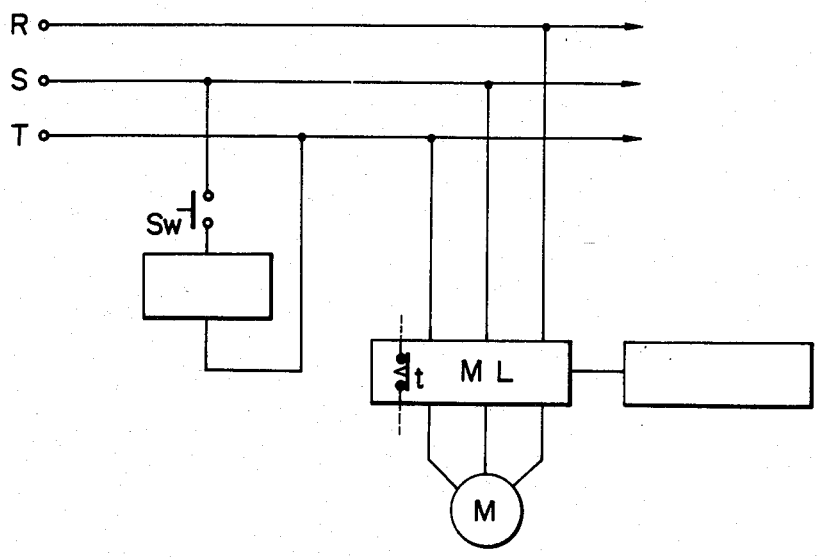
FIGS. 16 and 17 are a block diagram and a time chart, respectively, illustrating another form of the controller shown in FIG. 15.
Figure 17:
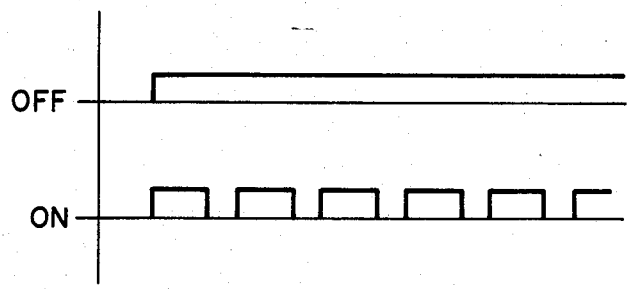

FIG. 16 shows a circuit for controlling the speed of a motor M employed to effect the travelling and traversing operation of the overhead travelling crane. In the circuit, a timer T is provided in a part of a solenoid-operated switch ML for the motor M, and pulses are generated in accordance with a time chart such as that shown in FIG. 17, whereby the speed of the motor M is limited. More specifically, the circuit effects control so as to decrease the speed of the motor M when the attachment apparatus 10D is operated through the control switches $P_1$ to $P_4$ during a cargo handling operation. It is to be noted that the reference symbols R, S, T represent a three-phase power supply.

Further, since there may be cases where the power supply for the crane is cut off by accident or by a power failure in a state wherein the safety bar 131D is in contact with the shelf B or the rack, it is possible to incorporate a protection circuit in case of an undesirable cut-off of the power supply. In other words, the circuit may be adapted to effect control such that, when the power supply is turned on again, the attachment apparatus 10D is allowed to move only in a direction along which it moves away from the shelf B or the rack.

Thus, it is possible according to the fifth embodiment to effect control such that, when the attachment apparatus 10D suspended from the overhead travelling crane collides (abuts) against the shelf B or the rack, the apparatus 10D is allowed to move only in a direction along which it moves away from the shelf B or the rack. It is therefore possible for the attachment apparatus 10D to carry out a cargo handling operation without any risk of collision.

Figure 18:
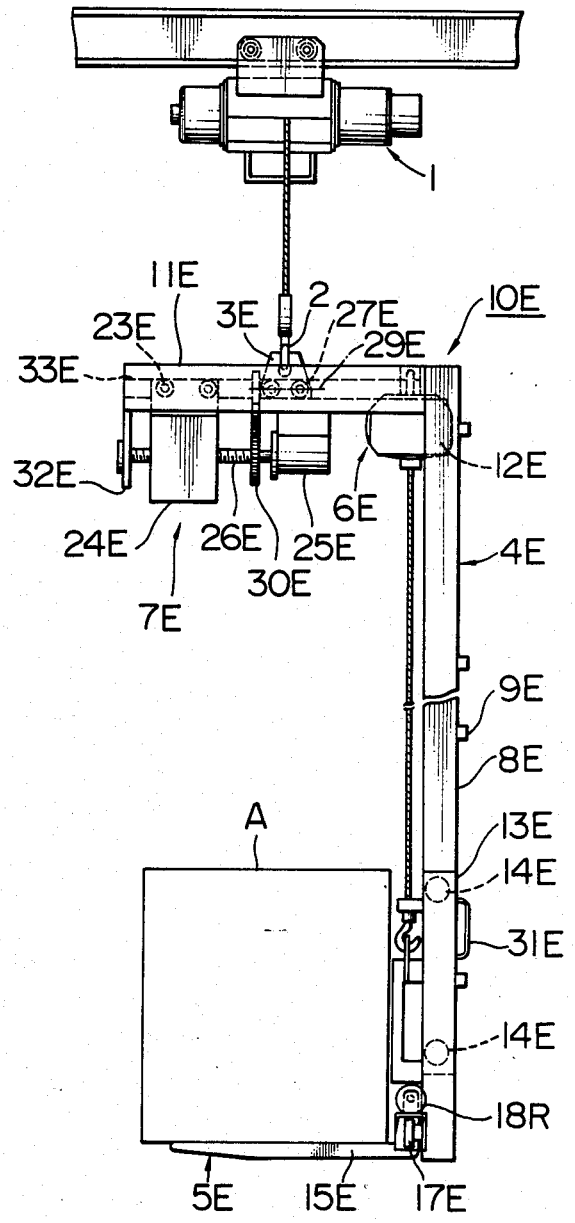
FIGS. 18 and 19 are a side elevational view and a front elevational view, respectively, of an attachment apparatus in accordance with a sixth embodiment of the invention, the apparatus being suspended from an overhead travelling crane.
Figure 19:
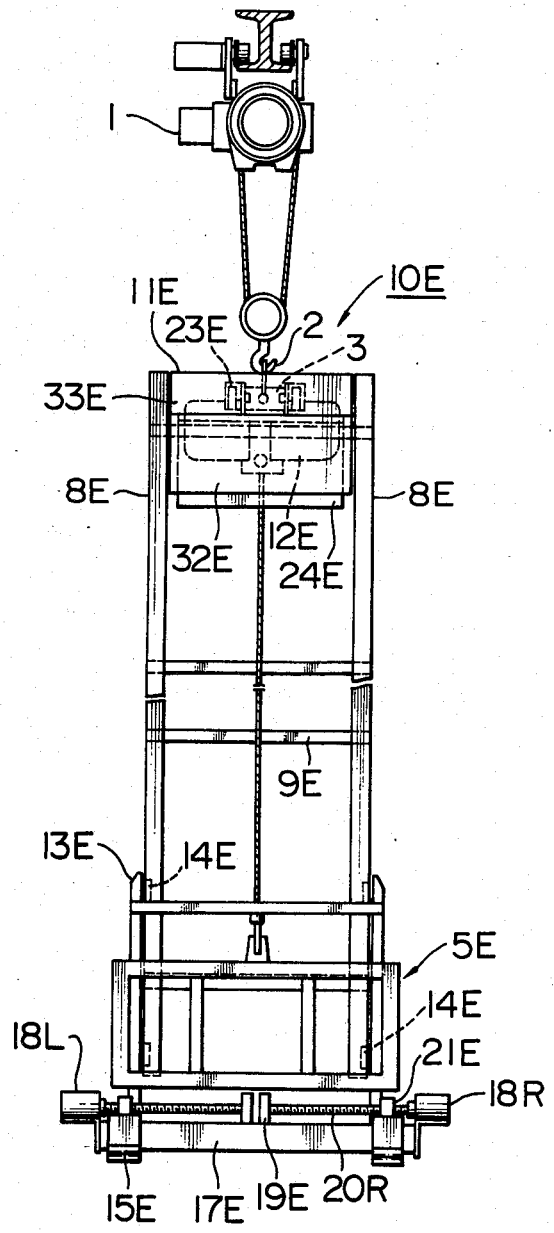
Figure 20:
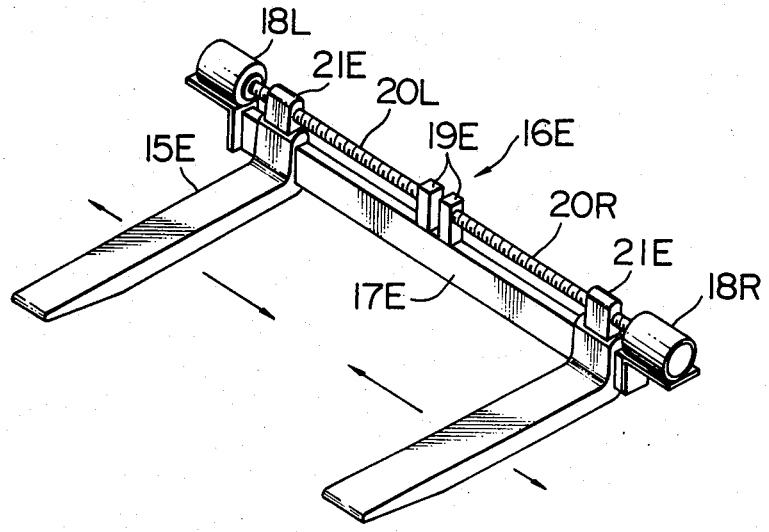
FIG. 20 is a perspective view of a fork adjusting mechanism employed in the invention.

Referring next to FIGS. 18 to 20, there is shown an attachment apparatus 10E in accordance with a sixth embodiment of the invention. The sixth embodiment will now be described only with respect to those points in which it is different from the first embodiment.

A driving section 6E adapted for vertically moving a fork section 5E along guide rails 8E is constituted by a hoist 12E. The hoist 12E is suspended from a rod secured to a ceiling member 11E. The fork section 5E is suspended by means of a hook which is secured to the end of a length of wire paid off from the hoist 12E.

The fork section 5E includes a pair of fork members 15E which are adjustable in terms of a distance therebetween, and a fork adjusting mechanism 16E mounted on a fork frame 13E and adapted to adjust the distance between the fork members 15E.

Figure 21:
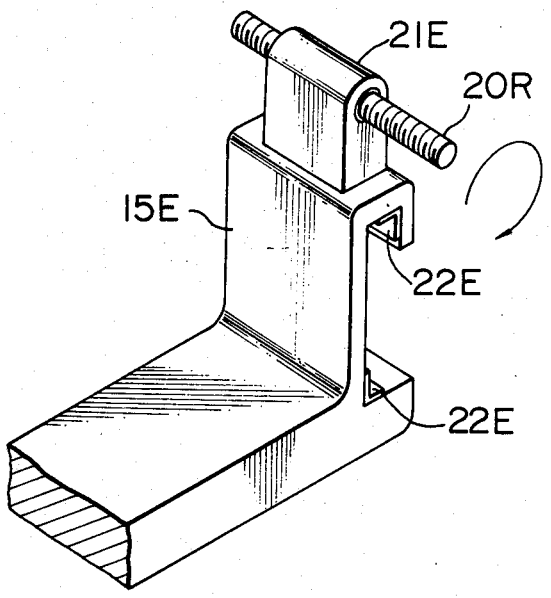
FIG. 21 is a fragmentary perspective view of the fork adjusting mechanism shown in FIG. 20.

Referring to FIGS. 20 and 21, the fork adjusting mechanism 16E includes a guide rod 17E secured to the fork frame 13E, motors 18R, 18L respectively mounted on both ends of the guide rod 17E, screw bolts 20R, 20L each of which has one end connected to the output shaft of the corresponding one of the motors 18R, 18L and the other end rotatably born by the corresponding one of the blocks 19E secured to the guide rod 17E, and movable blocks 21E respectively secured to the proximal ends of the fork members 15E and threadedly engaged by the screw bolts 20R, 20L. One end portion of each of the fork members 15E has a cross-section so shaped that it can partially surround the guide rod 17E, and further has plain bearings 22E mounted therein in the manner shown in FIG. 21 for the purpose of improving the slidability of the fork member relative to the guide rod 17E.

Figure 22:
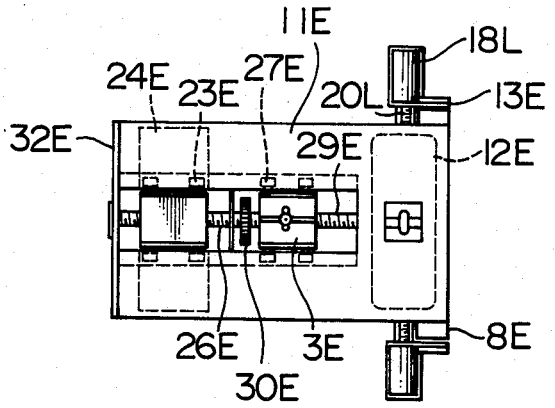
FIG. 22 is a plan view of the attachment apparatus shown in FIGS. 18 and 19.
Figure 23:
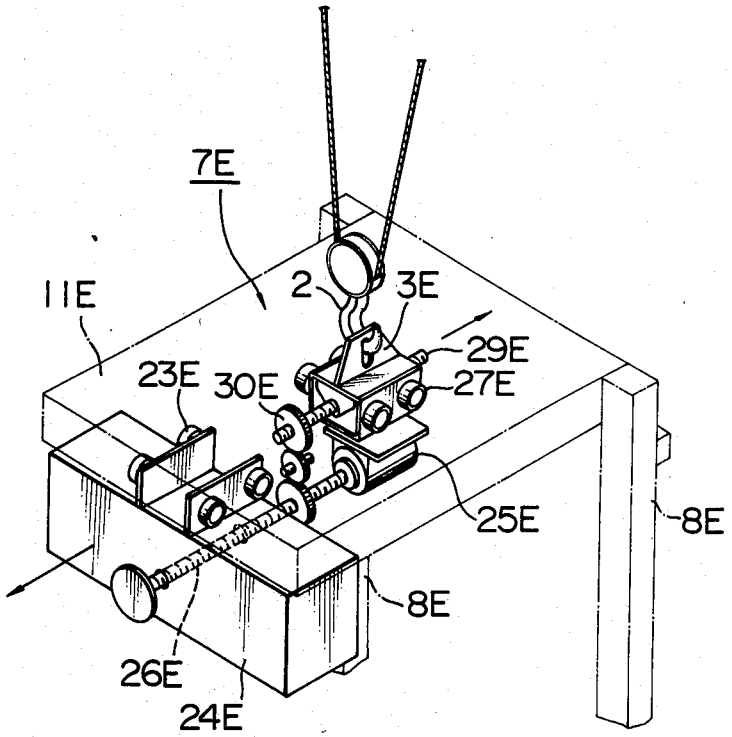
FIG. 23 is a fragmentary perspective view of a position control mechanism employed in the invention.
Figure 24:
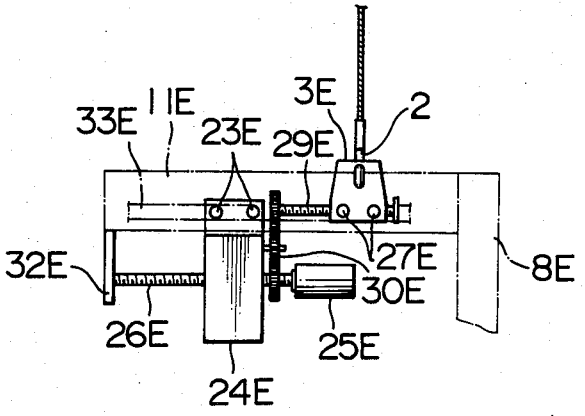
FIGS. 24 and 25 are schematic side elevational views of the position control mechanism shown in FIG. 23, which illustrate the operation of the mechanism.

Referring next to FIGS. 22 and 23, there is shown a position control mechanism 7E for the attachment apparatus 10E. This mechanism includes: a counter-weight 24E having two pairs of rollers 23E rotatably mounted on its upper side; a driving motor 25E; a first screw bolt 26E which is screwed into a threaded bore formed in the counter-weight 24E and has one end thereof connected to the output shaft of the driving motor 25E and the other end rotatably borne by an end plate 32E of a ceiling member 11E; a suspension member 3E which has two pairs of rollers 27E rotatably mounted on both its sides and is adapted to be suspended by means of the hook 2 of the overhead travelling crane 1; a second screw bolt 29E which is screwed into a threaded bore formed in the suspension member 3E and has both its ends rotatably borne by the ceiling member 11E; and a gear device 30E disposed between the first and second screw bolts 26E, 29E. The rollers 23E on the counter weight 24E and the rollers 27E on the suspension member 3E are adapted to roll in guide grooves 33E which are formed on the ceiling member 11E.

Figure 26:
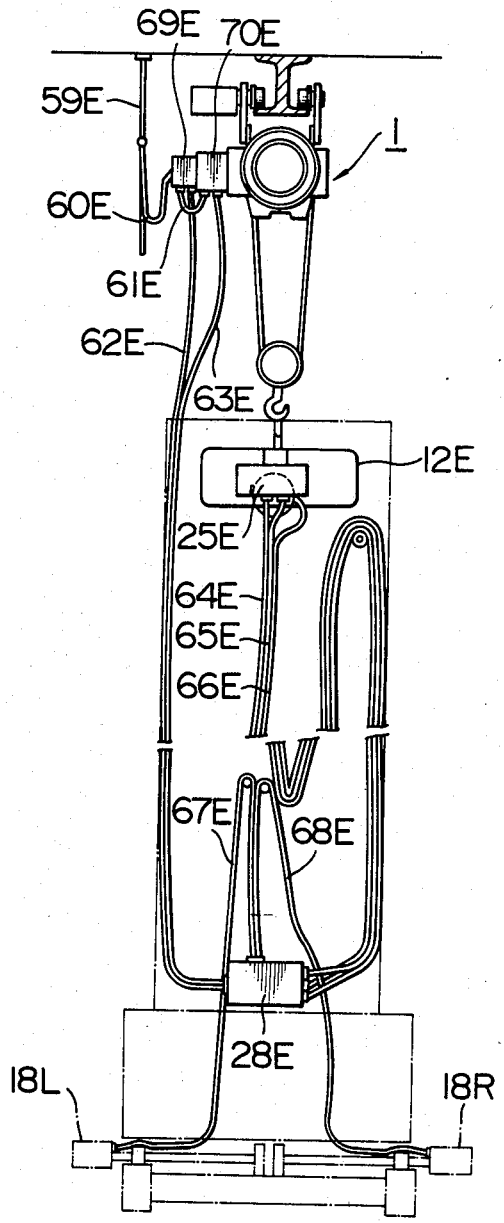
FIG. 26 shows wiring led to the overhead travelling crane and the attachement apparatus.
Figure 27:
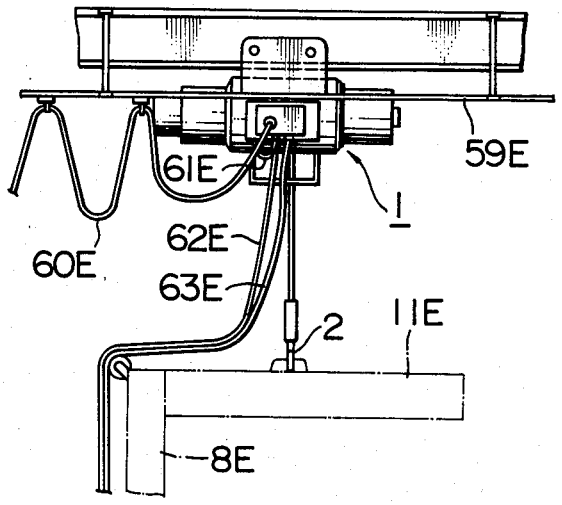
FIG. 27 shows the connection between the overhead travelling crane on one hand and feed and signal lines on the other.
Figure 28:
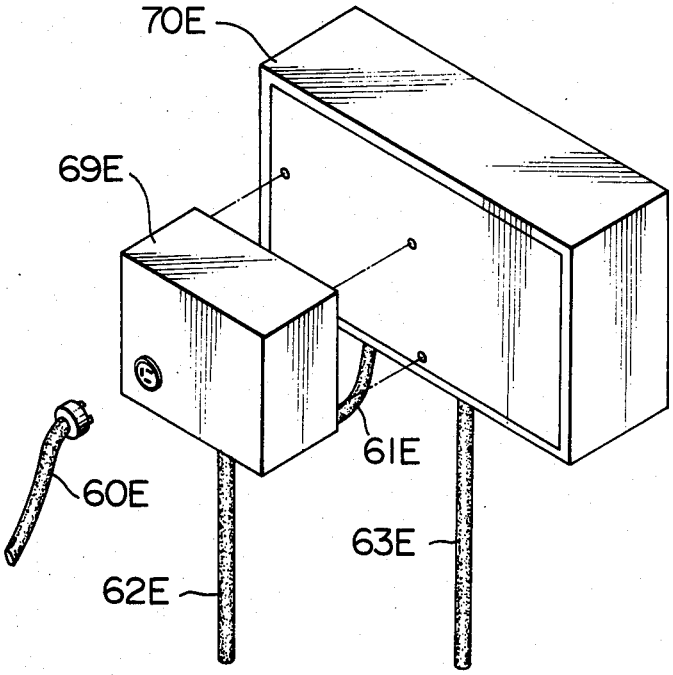
FIG. 28 is a perspective view of first and second connection boxes which are installed on the overhead travelling crane.

Referring to FIGS. 26 to 28, a power feed line 60E from an external power supply is supported by a support member 59E mounted on the ceiling and is connected to a first connection box 69E. Power feed lines 61E and 62E led out from the first connection box 69E are respectively connected to a second connection box 70E and a control box 28E of the attachment apparatus 10E. Although not shown in FIGS. 18 and 19, the control box 28E operated by the operator is mounted on the attachment apparatus 10E at a position where it is easy for the operator to operate the same. Signal lines 63E and 66E led out from the control box 28E are respectively connected to the second connection box 70E of the overhead travelling crane 1 and the hoist 12E as well as the counter-weight driving motor 25E. Power feed lines 64E, 65E, 67E and 68E led out from the control box 28D are respectively connected to the hoist 12E, the counter-weight driving motor 25E and the fork adjusting motors 18R and 18L.

Figure 25:
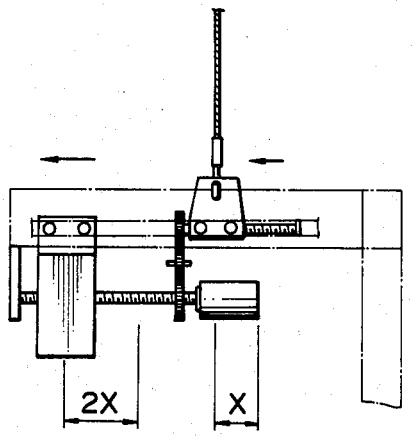

In operation, when the article A is to be scooped up and conveyed, the overhead travelling crane 1 is first actuated to move the attachment apparatus 10E to the position where the article A is placed. During this movement, it is possible for the attachment apparatus 10E to maintain its stable positon without swinging since the apparatus 10E has its handles 31E (see FIG. 18) held by the operator. Then, the operator actuates the driving section 6E by operating the control box 28E so as to move the fork members 15E vertically in such a manner that their position is matched with the position of the article A. At the same time, the motors 18R and 18L are actuated to adjust the distance between the fork members 15E in accordance with the size of the article A. Under this set of conditions, the overhead travelling crane 1 is operated in such a manner that the article A is scooped up by the fork members 15E. Then, the driving section 6E is actuated to raise the article A. At this time, the center of gravity of the article A may be undesirably offset from the vertical prolongation of the position of suspension of the attachment apparatus 10E, which fact may lead to tilting of the attachment apparatus 10E as a whole. In such a case, the counter-weight 24E is moved by actuating the driving motor 25E and, at the same time, the position of suspension of the counter-weight 24E is moved through the gear device 30E in such a manner that the attachment apparatus 10E as a whole is suspended vertically. As shown in FIG. 25, the gear ratio of the gear device 30E is determined such that the movement of the counter-weight 24E is twice as much as the movement of the position of suspension of the attachment apparatus 10E. Alternatively, it is possible to set the gear ratio of the gear device 30E at 1:1 and select the pitch of the second screw bolt 29E so as to be a half of that of the first screw bolt 26E.

Figure 29:
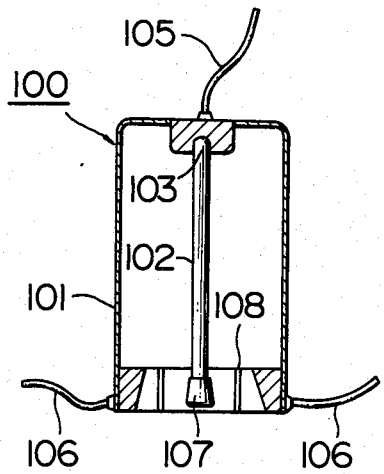
FIGS. 29 to 32 show in combination a tilting sensor employed in the invention.

Referring next to FIGS. 29 to 32, there is shown a tilting sensor 100 which constitutes the position control mechanism incorporated in the attachment apparatus 10E in accordance with the sixth embodiment shown in FIGS. 18 to 20. The tilting sensor 100 is mounted at an appropriate position on the attachment apparatus 10E. As shown in FIG. 29, the tilting sensor 100 has a hollow cylindrical casing 101 in which a contact rod 102 is suspended from a pivot 103. The tilting sensor 100 is arranged such that the contact rod 102 is directed vertically relative to the surface of the ground (in the gravitational direction) by virtue of its own weight for any tilting condition of the cylindrical casing 101.

Figure 31:
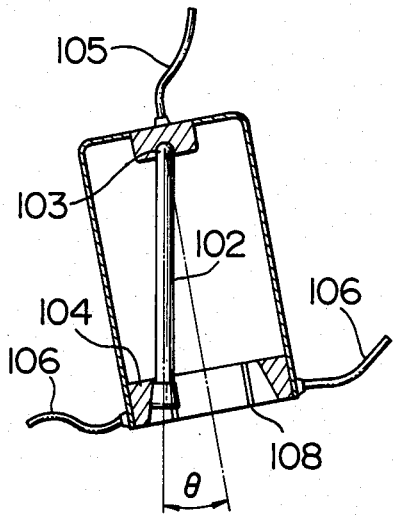
Figure 32:
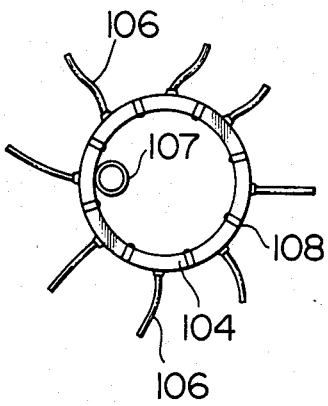

Further, the cylindrical casing 101 has a plurality of contact members 104 formed on the inside of its lower surface at predetermined distances, the contact members 104 being capable of passing even a very small current. The contact rod 102 has a contact portion 107 formed as to be able to contact any of the contact members 104 when the cylindrical casing 101 tilts. Thus, the tilting sensor 100 serves as a switch by means of the contact portion 107 and the contact members 104 for the purpose of sensing the tilting direction of the attachment apparatus 10E from the inclination angle $\theta°$ of the cylindrical casing 101 as shown in FIGS. 31 and 32. It is to be noted that the reference numerals 105 and 106 denote signal lines, while the numeral 108 represents separator members each separating two adjacent contact members 104.

Figure 33:
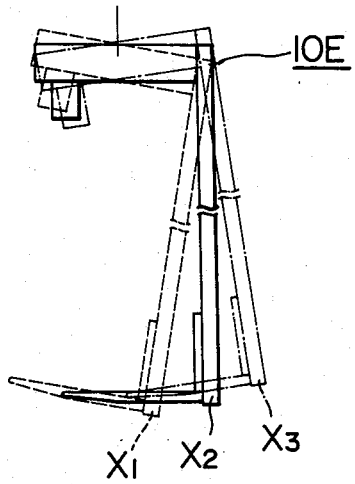
FIG. 33 shows the manner in which the attachment apparatus undesirably tilts in the forward and backward directions.

FIG. 33 shows the manner in which the attachment apparatus 10E tilts in the forward and backward directions during a cargo handling operation. When the article A being handled is relatively heavy, the attachment apparatus 10E may tilt in such a way as that shown by the reference symbol $X_3$; when the article A is relatively light-weight, the attachment apparatus 10E may tilt in a way shown by the symbol $X_1$ by virtue of its own weight. It is to be noted that the symbol $X_2$ represents a state wherein the attachment apparatus 10E is not inclined at all.

Figure 34:
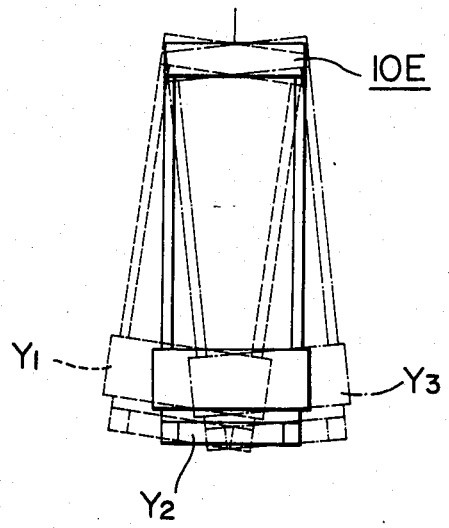
FIG. 34 shows the manner in which the attachment apparatus undesirably tilts in the rightward and leftward directions.

On the other hand, FIG. 34 shows the manner in which the attachment apparatus 10E tilts in the rightward and leftward directions when handling an article of continuous length. It is possible to scoop up an article of continuous length in the state shown by the reference symbol $Y_2$ if the article is held at its longitudinal center. In the case of an article which has different dimensions at its opposing ends, it is possible by the use of the tilting sensor 100 to find the most appropriate position of the article for scooping it up. The attachment apparatus 10E may tilt in such a way as that shown by the reference symbols $Y_1$ and $Y_3$, depending upon the position along the length of the article where it is scooped up.

Figure 35:
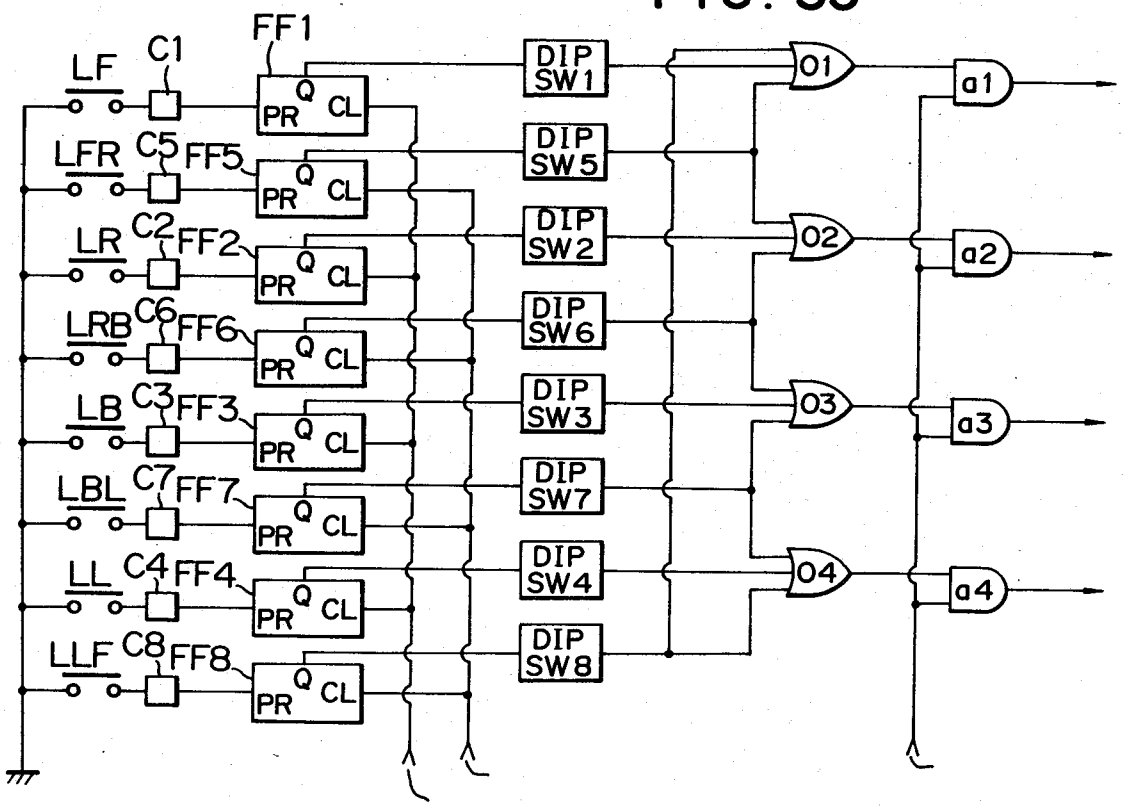
FIG. 35 is a circuit diagram of a controller for the attachment apparatus.
Figure 36A:
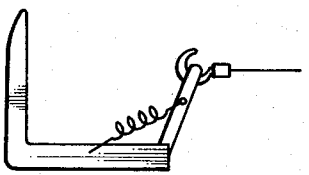
FIGS. 36A and 36B are schematic views of a prior art attachment apparatus.
Figure 36B:
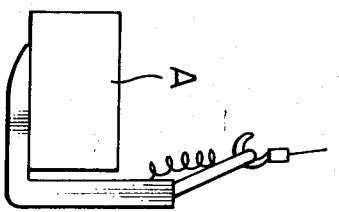

FIG. 35 is a circuit diagram of a control circuit for the attachment apparatus 10E which is equipped with the tilting sensor 100. The arrangement of the control circuit will now be described in connection with its operation.

Figure 30:
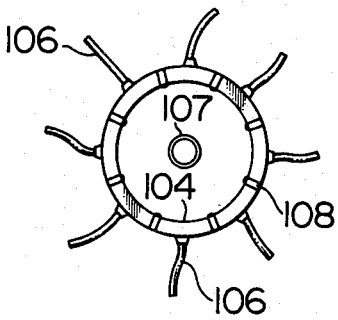

The reference symbols LF, LFR, LR, LRB, LB, LBL, LL and LLF respectively represent possible switching relationships between the contact members 104 and the contact portion 107 shown in FIGS. 29 and 30.

The symbols $C_1$ to $C_8$ respectively denote circuits which generate "H" (high) signals when the corresponding switches LF, LFR, LR, LRB, LB, LBL, LL and LLF are short-circuited. On the other hand, the symbols $FF_1$ to $FF_8$ respectively denote flip-flop circuits, while the symbols $DIPSW_1$ to $DIPSW_8$ respectively represent dip switch circuits each serving as a timer circuit which is arranged such as to output an "H" signal when an "H" signal is continuously input thereto for a predetermined period of time. Further, the symbols $O_1$ to $O_4$ represent OR circuits, while the symbols $a_1$ to $a_4$ denote AND circuits. The following various tilting conditions of the attachment apparatus 10E are respectively sensed by the switches in the control circuit:

LF: forward tilting
LR: rightward tilting
LB: backward tilting
LL: leftward tilting
LFR: forwardly rightward tilting
LRB: rightwardly backward tilting
LBL: backwardly leftward tilting
LLF: leftwardly forward tilting When the attachment apparatus 10E tilts rightwardly ($X_3$) as viewed in FIG. 33 upon scooping up the article A, the third switch LR in FIG. 35 is short-circuited, whereby an "H" signal generated from the circuit $C_2$ is input to the PR terminal of the flip-flop circuit $FF_2$. In consequence, an "H" signal is generated from the Q-terminal of the flip-flop circuit $FF_2$ and is input to the timer circuit $DIPSW_2$. After a predetermined period of time has passed, an "H" signal is generated from the timer circuit $DIPSW_2$ and is input to the AND circuit $a_2$ through the OR circuit $O_2$. At this time, when a desired switch is actuated by hand, an operating signal "H" is generated, and an "H" signal is output from the AND circuit $a_2$ as a rightward movement signal, whereby the motor 7 is rotated in a given direction. After the balancing correction has been properly completed, an "H" signal is input to the CL terminal of the flip-flop circuit $FF_2$ in response to a cancelling signal A, and the "H" signal from the AND circuit $a_2$ is thereby cancelled.

When the attachment apparatus 10E tilts in a forwardly rightward direction, the switch LFR is short-circuited, and an "H" signal is generated from the Q-terminal of the flip-flop circuit $FF_5$. After a predetermined period of time has elapsed, an "H" signal is generated from the timer circuit $DIPSW_5$ in a manner similar to the above.

Thus, the "H" signal is input to both the OR circuits $O_1$ and $O_2$, and "H" signals are respectively output from the AND circuits $a_1$ and $a_2$ in response to the operation of the switches, whereby balancing corrections can be effected in the forward and rightward directions at the same time.

The reason why two kinds of release signal A and B are provided as shown in FIG. 35 is that tilting may occur in a single direction or in a composite of two directions from among the above-described possible tilting directions, that is, the forward, backward, rightward and leftward directions, and since there is a strong possibility of a difference occurring in terms of the degree of tilting, it is necessary for a release signal to be generated for each individual tilting condition of the attachment apparatus 10E. These release signals may be generated by switches of any desired type which are additionally provided. Alternatively, the above-described "H" signal may be generated by arranging the tilting sensing switches such that the "H" signal is generated when they are opened.

Further, the reason why the operating signal C is input to each of the AND circuits $a_1$ to $a_4$ which respectively generate correction signals, such as a forward movement signal, a rightward movement signal, a backward movement signal and a leftward movement signal, is that the attachment apparatus 10E may swing when it is in a tilting condition, and if the tilting is automatically corrected by adjusting the balance in the state wherein the apparatus 10E is swinging, the degree of swing might be increased. Thus, it is necessary to manually generate an operating signal for correction after confirming that the swinging movement of the apparatus 10E has ceased.

For the above-described purpose, it is possible to arrange the switches such that they automatically sense swinging movement of the attachment apparatus 10E and automatically generate an "H" signal by sensing the disappearance of the swing.

Thus, according to the present invention, the position control mechanism is provided in the control circuit for the attachment apparatus which is suspended from the overhead travelling crane. Accordingly, when the attachment apparatus tilts as the result of scooping up an article, it is possible to sense the degree and direction of tilting of the apparatus in any of the forward, backward and sideward directions and to correct the tilting by a manual operation.

Although the invention has been described through specific terms, it is to be noted here that the described embodiments are not exclusive and various changes and modifications may be imparted thereto without departing from the scope of the invention which is limited solely by the appended claims.

What is claimed is:

1. An attachment apparatus adapted to be suspended from a crane, comprising:

a frame section adapted to be suspended from a hook attached to said crane;

a fork section vertically movably mounted on said frame section and adapted to scoop up an article;

a driving section for vertically driving said fork section;

a first driving means for moving said fork section relative to said frame section in a lateral direction perpendicular to a direction in which said fork section scoops up the article;

a counter weight provided on said frame section;

a hanging means provided on said frame section for engaging with said hook of the crane; and a second driving means for simultaneously moving said hanging means and said counter weight relative to said frame section in opposite directions parallel to the direction in which said fork section scoops up the article;

at least one of said first and second driving means being actuated to control a position of said attachment apparatus.

2. An attachment apparatus as set forth in claim 1, wherein said driving means moves said counter weight by a distance twice as great as the distance of movement of said hanging means.

3. An attachment apparatus as set forth in claim 1, further comprising a sensor means for automatically sensing the tilting of said attachment apparatus in forward, backward and sideward directions.

4. An attachment apparatus as set forth in claim 3, wherein said sensor senses eight possible tilting directions.

5. An attachment apparatus as set forth in claim 3, further comprising means for sensing swinging movements of said attachment apparatus and wherein positional control of said attachment apparatus is possible only after said swinging movement sensing means signals that a swinging movement of said attachment apparatus has ceased.

6. An attachment apparatus as set forth in claim 1, wherein said frame section comprises a mast which can be increased in its overall length by means of an extension.

7. An attachment apparatus as set forth in claim 1, wherein said first driving means comprises a guide rod provided on said frame section, motors respectively mounted on opposite ends of said guide rod, a pair of screw bolts, each of said screw bolts having one end connected to an output shaft of one of said motors and another end journaled by a block secured to said guide rod, movable blocks each secured to one end of said fork and adapted to be threadedly engaged by the respective screw bolts; and bearing members mounted on each end of said fork to be slidable on said guide rod.

8. An attachment apparatus as set forth in claim 1, wherein said frame section comprises a pair of handles and a switch box provided adjacent to said handles for control.

9. An attachment apparatus as set forth in claim 1, wherein said fork section comprises two prongs, and said first driving means acts to move said prongs independently of each other.

* * * * *